United States Patent [19]

Mazoff

[11] 4,176,499

[45] Dec. 4, 1979

[54] DRILL SHARPENER

[76] Inventor: Joseph Mazoff, 3136 Federal Ave., El Paso, Tex. 79930

[21] Appl. No.: 840,304

[22] Filed: Oct. 7, 1977

Related U.S. Application Data

[63] Continuation-in-part of Ser. No. 775,972, Mar. 9, 1977, abandoned, which is a continuation-in-part of Ser. No. 639,221, Dec. 10, 1975, abandoned.

[51] Int. Cl.[2] ..... B24B 3/28

[52] U.S. Cl. ..... 51/124 R; 51/219 R

[58] Field of Search ..... 51/5 D, 96, 98, 98.5, 51/124, 125, 125.5, 219 R, 277

[56] References Cited

U.S. PATENT DOCUMENTS

| | | | |
|---|---|---|---|
| 614,092 | 11/1898 | Eames | 51/219 R |
| 690,398 | 1/1902 | Chandler | 51/219 R |
| 1,576,311 | 3/1926 | Desjardins | 51/219 R |
| 2,142,923 | 1/1939 | Stocking | 51/219 R X |
| 2,486,335 | 10/1949 | Smith | 51/219 R |
| 2,524,279 | 10/1950 | Van Wyk | 51/219 R X |
| 2,580,884 | 1/1952 | Bowman | 51/124 R X |
| 2,583,159 | 1/1952 | Swanson | 51/219 R |
| 3,374,587 | 3/1968 | Simpkins | 51/219 R |

*Primary Examiner*—Nicholas P. Godici

*Attorney, Agent, or Firm*—Don J. Flickinger

[57] ABSTRACT

The disclosure relates to a simple drill sharpener for sharpening cutting points of twist drills; the sharpener having a drill guide and holder adapted to hold a drill in certain axial alignment and having means for engaging the trailing edge of one flute of a drill in cooperation with an abutment means which supports the shank end of the drill such that when one facet of the drill point is ground on a grinding wheel, torque is imparted to the drill and forcing it in a rotary direction to maintain it in firm engagement with said flute edge engaging means and with said abutment means, thereby precisely maintaining longitudinal axial position of the drill, and fixing the drill against rotation relative to the holder. Further, the disclosure relates to a carrier for the drill guide and holder, together with mounting means which permits adjustment of the carrier and the drill guide and holder about a generally horizontal axis and generally vertical axis, and further provides for the sweeping action of the drill guide and holder relative to a grinding wheel about an axis parallel to the rotary axis of the grinding wheel which is provided with a grinding face disposed at right angles to the rotary axis of the grinding wheel. The guide and drill holder may be replaced by a table for supporting a tool to be sharpened by a grinding wheel.

17 Claims, 29 Drawing Figures

FIG.I.

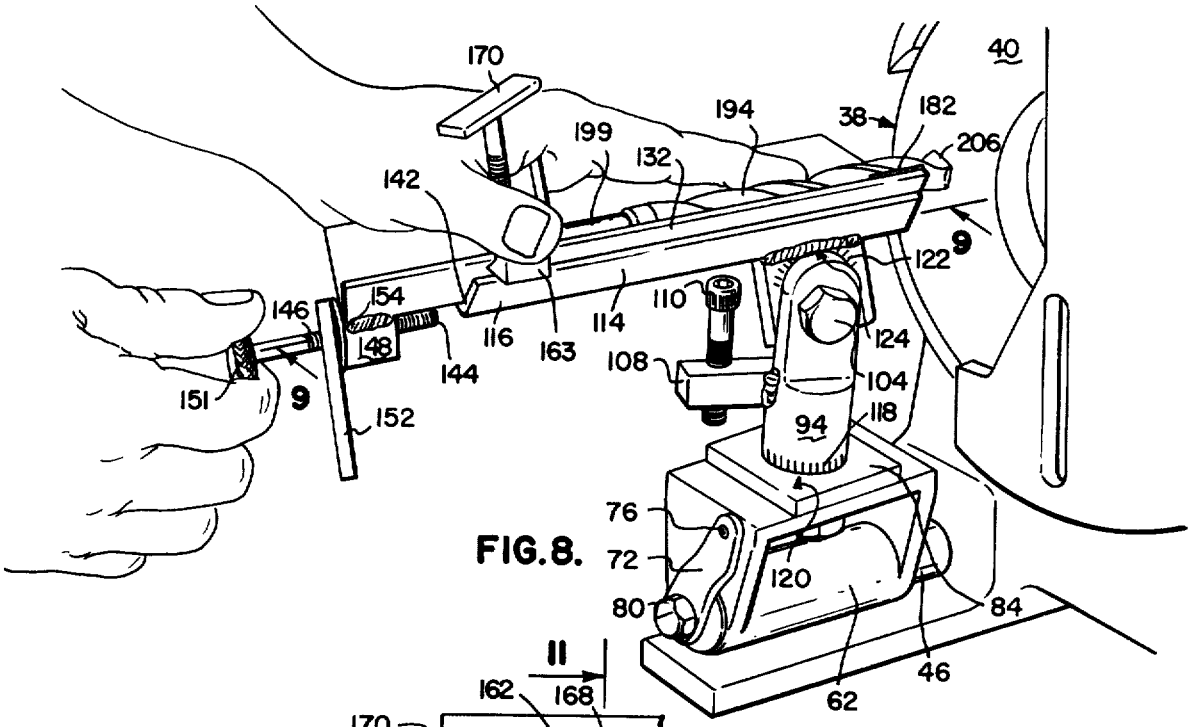
FIG. 8.
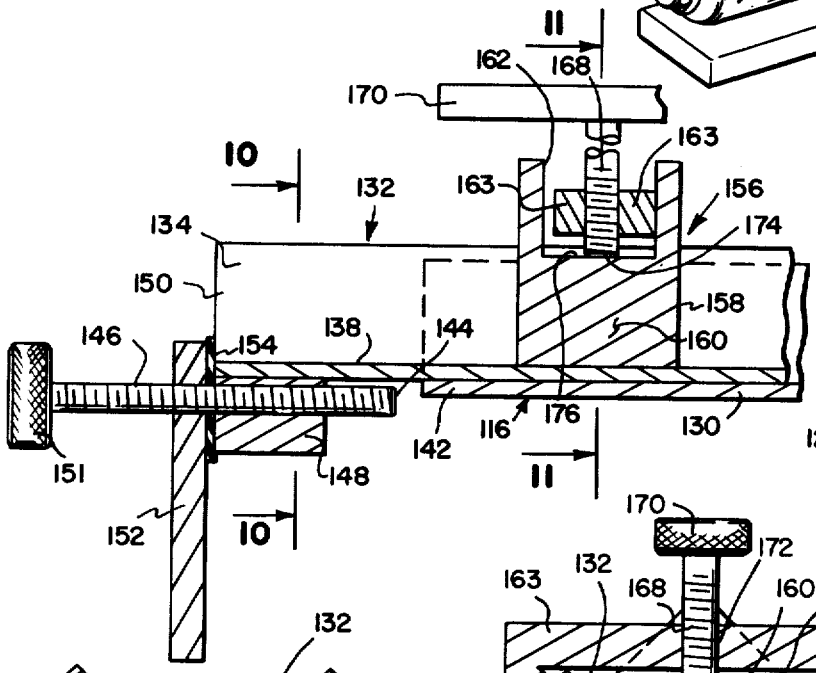
FIG. 9.
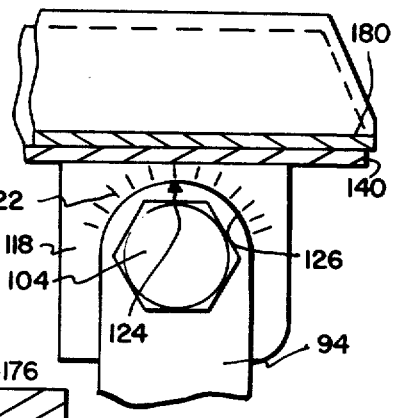
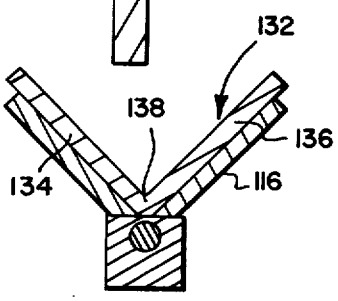
FIG. 10.
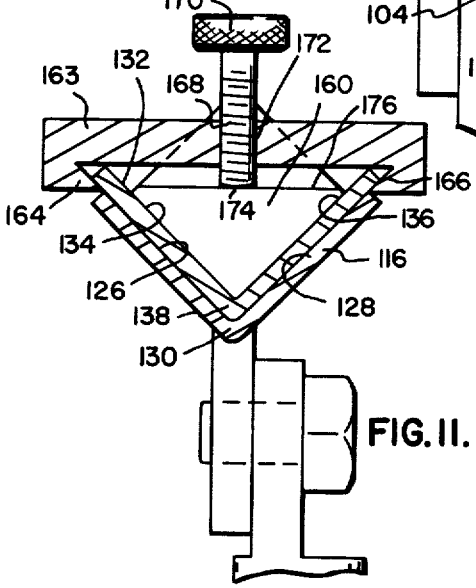
FIG. 11.

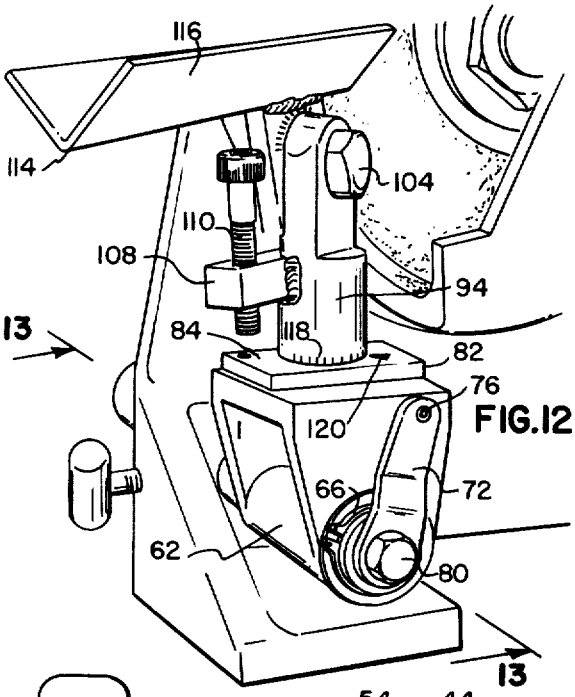
FIG.12.
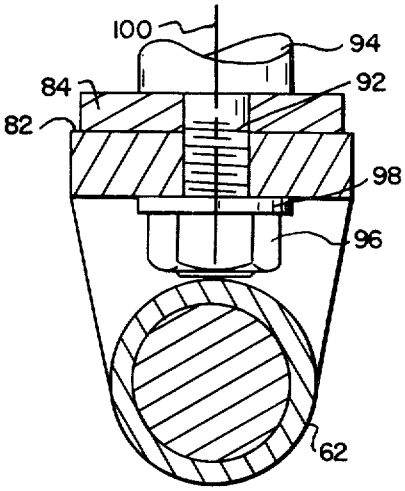
FIG.15.
FIG.14.
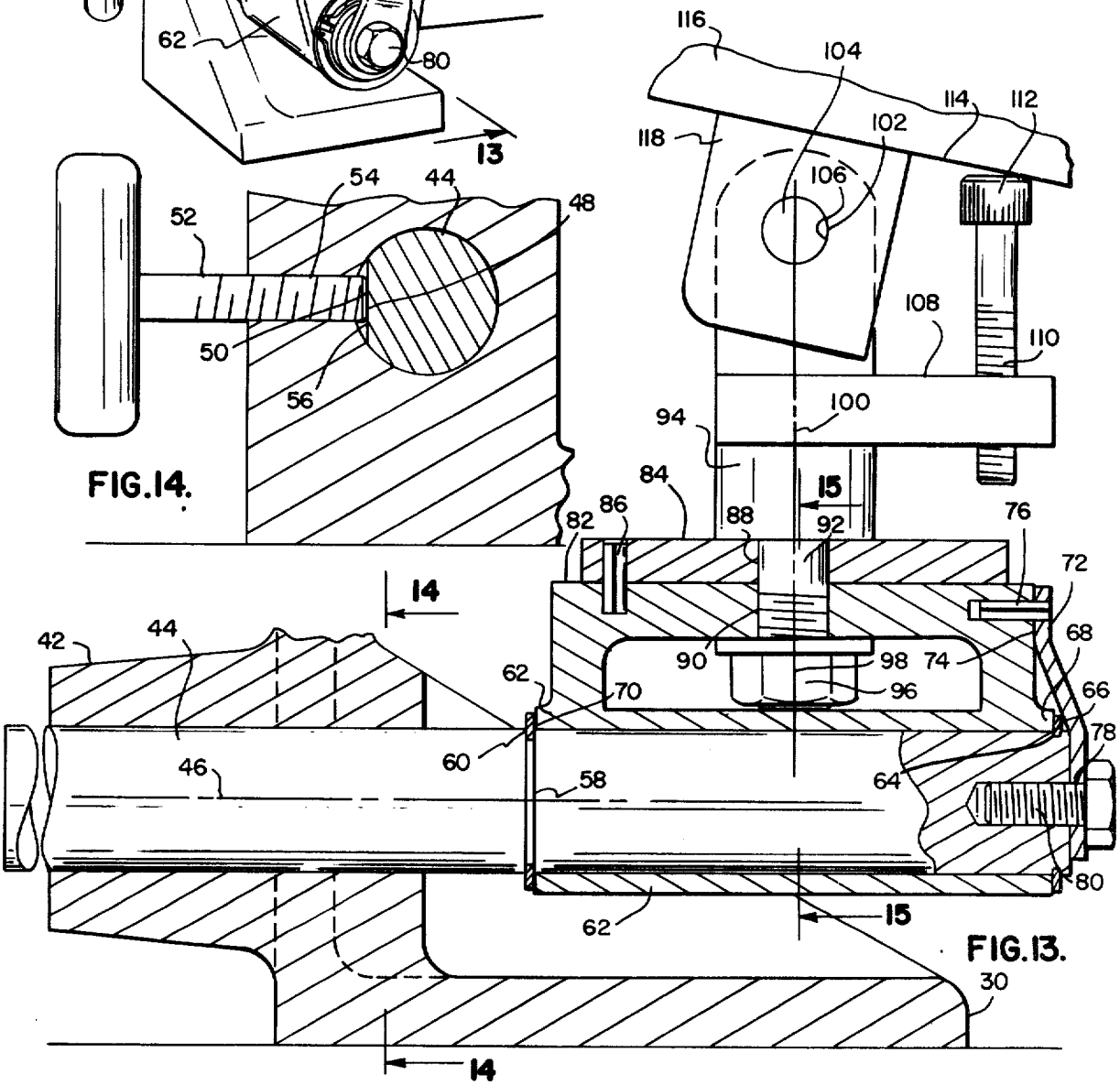
FIG.13.

DRILL SHARPENER

This application is a continuation-in-part of my copending application, Ser. No. 775,972, filed Mar. 9, 1977 for DRILL SHARPENR, now abandoned which application is, in turn, a continuation-in-part of patent application Ser. No. 639,221 filed Dec. 10, 1975 for DRILL GRINDING DEVICE now abandoned.

BACKGROUND OF THE INVENTION

Drill sharpening machines and apparatus of the prior art, for sharpening large drills, have been relatively large, limited in drill capacity range, expensive, time consuming and complicated to operate in order to attain precision drill point sharpening.

Consequently, many machinists have resorted to the hand holding of drills while sharpening the facets on the point of a drill. However, such sharpening of drills depends entirely upon the skill of the operator and has been substantially unsatisfactory for some precision drill operations. A properly sharpened twist drill will have cutting lips at each facet of the drill point which are precisely disposed at the same conical angle, as well as precisely disposed relative to each other in an axial direction so that both cutting lips cut evenly so as to uniformly maintain proper axial alignment operation of the drill and to prevent uneven loading of the cutting lips laterally of the axis of the drill, and also to maintain the ability of the drill to perform for long periods of time without requiring the resharpening. Furthermore, a properly sharpened drill does not tend to overhead one cutting lip more than another and therefore, the drill is maintained at a uniform temperature at opposite sides of its central or rotary axis and further, operates at a lower temperature so that it is capable of a greater amount of work within a given period of time. In addition, a properly sharpened drill produces a more accurate hole size.

The precision sharpening of drill points has therefore been limited to rather complicated machines which are relatively complicated to operate and which require a substantial amount of time for setting up a drill to be sharpened. Furthermore, precision drill sharpening machines are very expensive and many machine shops cannot afford to have one. Additionally, it has been well substantiated that other current drill sharpening machines are limited as to the drill diameter size range.

Every twist drill has a least two flutes extending throughout the length thereof. Each such flute has a leading or cutting edge and a trailing edge with a helical groove between these edges. From the practical viewpoint, it is undesirable, if not impossible, to utilize either the cutting edge or the groove as a guide for positioning the drill relative to the grinding wheel. This undesirability is attributed to the fact that the cutting edge is subject to a large amount of wear and occasionally engages hard spots in the work, resulting in the formation of knicks, small recesses and the like in the cutting edge. While the groove is not quite so susceptible of being marred or impaired as the cutting edge, it is of large area and is also unsuitable for use as a guide.

The present invention is founded largely on the fact that the trailing edge of the flute is the ideal guide for positioning the drill during sharpening because it does not become impaired or damaged during drillig operations. This is due to the trailing edge being relieved, therefore providing providing clearance between flute surface and the cylindrical walls of the hole in the parent metal. Thus, there is no wear or distortion imposed on said trailing edge of the flute.

SUMMARY OF THE INVENTION

The invention relates to a very simple manually operable drill sharpener capable of highly precise drill sharpening with a minimum of time and expense. The machine of the invention is so simple and economical that is may be afforded by any machine shop so as to contribute to the efficiency of such a shop by providing precision drill points which are capable of the highest degree of performance and accuracy. The invention comprises a novel drill guide and holder adapted to maintain the rotary axis of a drill precisely aligned with the face of a cutting wheel at an angular disposition so as to grind point facets on the drill. The guide and holder of the invention has a means which engages the trailing edge of a flute of a respective drill with a point contact in contrast to a line contact, and a means providing an abutment for the shank end of a drill and the holder being disposed so as to hold the drill in grinding position at the surface of a grinding wheel which roates in a direction to impart rotary torque to the drill which is in the direction which causes the flute of the drill to be held firmly against the flute trailing edge engaging means of the holder and which also causes the end of the drill shank to bear precisely against the abutment means of the drill guide and holder.

The drill guide and holder is also a simple mechanism, such as a generally V-shaped trough in which a drill may be manually held in position with its shank end against the aforementioned abutment and with the trailing edge of one flute of the drill engaged by the flute trailing edge engaging means such as to maintain a precise holding position with the torque applied to the drill by the grinding wheel as it grinds one facet of the cutting point of the drill. The guide and holder is open so that the drill may be quickly removed and rotated 180 degrees for the grinding of a second facet of the drill points with the same locating cooperative of the flute trailing edge engaging means and the shank end abutment means of the holder.

The drill guide and holder is longitudinally adjustably moveable in a carrier mounted on the frame of the machine and the carrier is adjustable about two axes, one which is generally horizontal and the other which is generally vertical. The drill guide and holder also is adjustable by screwthreaded means longitudinally in the carrier to provide coincidence of the point facets of the drill being ground by the surface of the grinding wheel of the machine. The grinding wheel surface is preferably disposed at right angles to the rotary axis of the wheel and means is also provided for sweeping the point of the drill across the face of the grinding wheel during the sharpening of each facet of the drill point so as to prevent grooving of the surface of the grinding wheel and to provide for uniform use of the entire surface of the wheel.

The aforementioned sweeping action of the drill point is generally diametrically of the wheel with the pivotal axis of the mounting means of the drill guide and holder being substantially parallel to the rotary axis of the grinding wheel which has its grinding surface at right angles to its rotary axis. Means is provided which may be carried by the aforementioned carrier for surfacing the grinding wheel while it is rotating by sweeping a finishing tool or dressing tool across the face of the wheel by moving the dressing tool about a pivotal axis which is parallel to the rotary axis of the wheel which has its grinding face at right angles to the rotary axis thereof. Thus, according to a method of the invention, the face of the wheel may be swept by a dressing tool which is moveable about an axis parallel to the rotary axis of the grinding wheel and whereby a drill may be sharpened subsequently by sweeping it about the same pivotal axis which is parallel to that of the grinding wheel and using the cutting face of the grinding wheel to sharpen the facet of the drill as it is swept thereover in the same manner that the dressing tool was originally used to finish the grinding surface of the wheel.

The flute trailing edge engaging means, forming a part of the drill guide and holder, is adpated to engage an edge of a drill flute and preferably the trailing edge of the flute.

The drill guide and holder of the invention is supported in a carrier and adjustable stop means is provided for locating the drill guide and holder relative to the grinding face of the grinding wheel of the machine so as to fix the longitudinal disposition of the drill such that subsequent facets of the cutting point thereof may be ground to exactly the same position longitudinally of the axis of the drill.

The drill guide and holder may be replaced by a table which supports a tool so that its cutting edges may be sharpened by the grinding wheel.

Accordingly, it is an object of the invention to provide a highly precise, very simple and economical drill sharpener which is very simple and easy to operate, very durable and requires a minimum amount of operational steps and time for the sharpening of the facets of drill points.

Another object of the invention is to provide a novel drill guide and holder having means such as V-shaped trough means or the like for holding a drill in axial alignment with the guide and wherein a drill flute engaging means engages the trailing edge of a flute of the drill with a point contact while an abutment means engages the end of the drill shank so as to provide for precise location of the drill in the holder when a facet of the drill point is being ground of the grinding wheel which imparts rotary torque holding the trailing edge of the flute of the drill against the flute engaging means of the holder, and holding the shank end of the drill precisely against the abutment means of the holder.

Another object of the invention is to provide a novel carrier means for supporting the drill guide and holder of the invention; said carrier means being adjustable about two axes which are at right angles to each other, preferably one of the axes being horizontal, and the other one vertical.

Another object of the invention is to provide a novel method for dressing a grinding wheel surface and for subsequently sharpening a drill thereon which in includes the sweeping of a dressing tool over the grinding surface of a wheel which is at right angles to its axis; and the sweeping motion being carried out by pivoting the dressing tool on an axis parallel to the rotary axis of the wheel and then subsequently grinding a drill point facet by sweeping the drill point facet over the grinding surface of the wheel about the same axis which is parallel to the rotary axis of the grinding wheel.

Another object of the invention is to provide a novel drill point cutting lip alignment device comprising a means for supporting the drill guide and holder of the invention with a drill therein such that a cutting lip of the drill point may be aligned with scribed lines on a plate so as to predetermine the disposition of the cutting lip as it relates to the grinding wheel to the horizontal and vertical axes about which the carrier of the drill guide and holder is disposed relative to the grinding plane of the grinding wheel.

Another object of the invention is to provide a drill guide and holder which is removeable and may be replaced by a table which supports a tool for grinding purposes.

And a further object of the invention is the provision of a drill sharpener having extremely wide drill size capacity and which eliminates conventional chucks, clamps or collects for immobilizing the drill.

Further objects and advantages of the invention may be apparent from the following specification, appended claims and accompanying drawings.

BRIEF DESCRIPTION OF THE DRAWINGS

FIG. 8 is a perspective view of the drill guide and holder of the invention located in the carrier of the machine and wherein an adjustable stop is being set relative to the drill guide and holder and the carrier to establish an axial longitudinal position of a drill relative to the surface of the grinding wheel of the macine;

FIG. 9 is an enlarged fragmentary sectional view taken from the line 9—9 of FIG. 8;

FIG. 10 is a cross sectional view taken from the line 10—10 of FIG. 9;

FIG. 11 is a cross sectional view taken from the line 11—11 of FIG. 9;

FIG. 12 is a perspective view of the carrier and its mounting mechanism for adjustably supporting it on two axes, namely a horizontal axis and a vertical axis;

FIG. 13 is an enlarged sectional view taken from the line 13—13 of FIG. 12;

FIG. 14 is a fragmentary sectional view taken from the line 14—14 of FIG. 13;

FIG. 15 is a fragmentary sectional view taken from the line 15—15 of FIG. 13;

DESCRIPTION OF THE PREFERRED EMBODIMENTS

Figure 1:
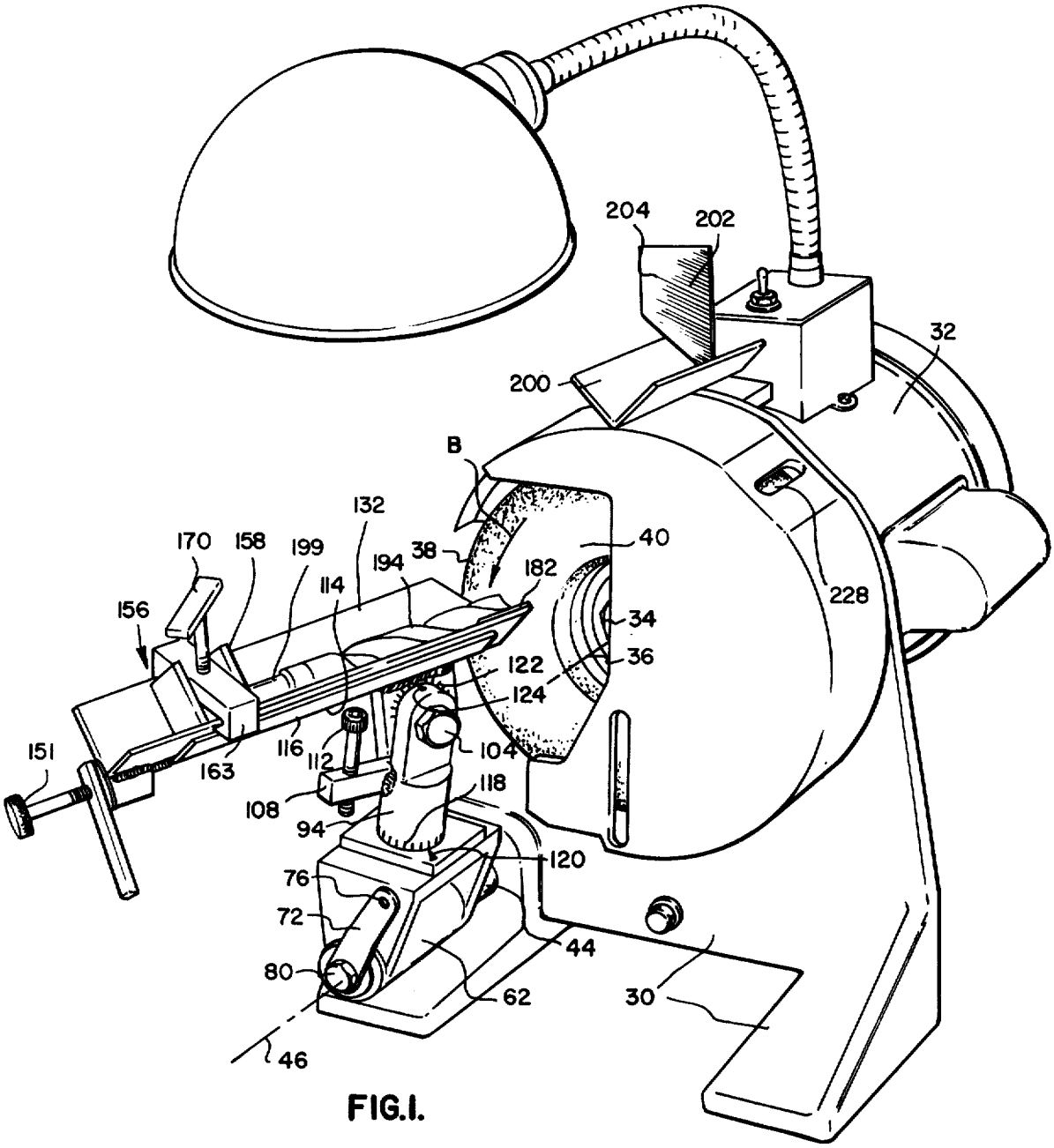
FIG. 1 is a perspective view of a drill sharpening machine in accordance with the present invention.
Figure 2:
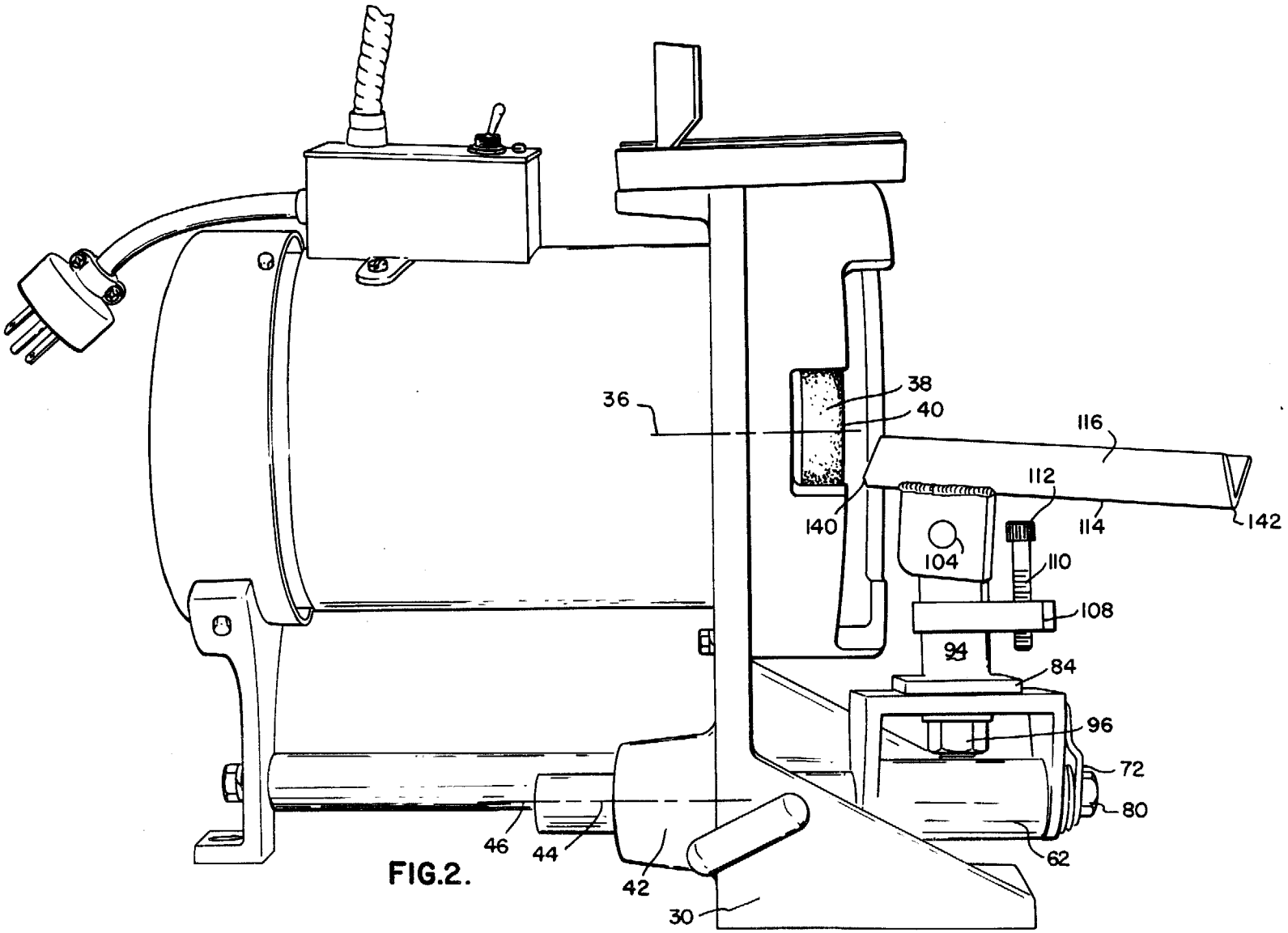
FIG. 2 is another perspective view of the machine shown in FIG. 1 taken from a different angle relative thereto.
Figure 3:
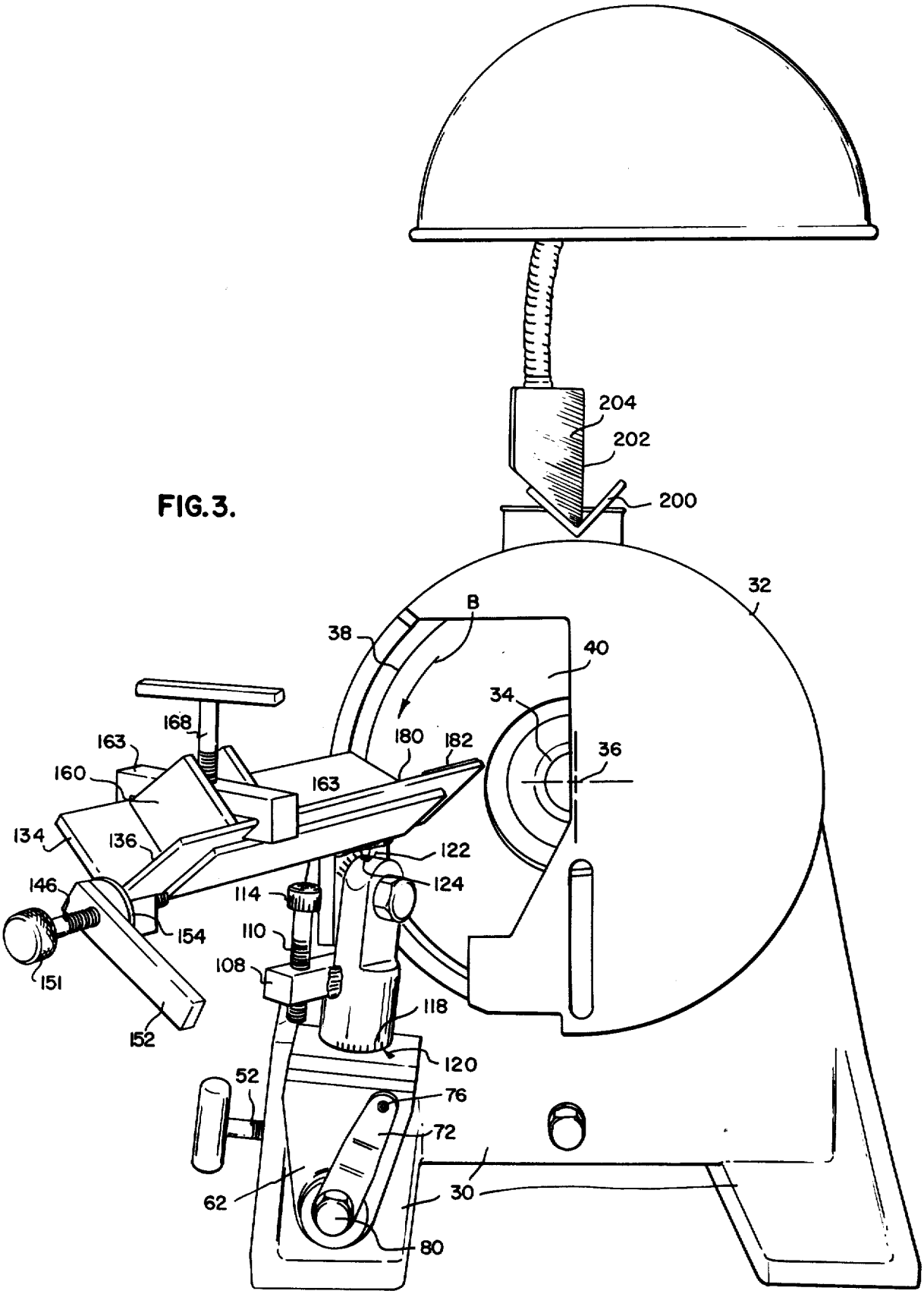
FIG. 3 is an end view of the machine of the invention, the view being substantially aligned with the rotary axis of the grinding wheel of the machine.

As shown in FIGS. 1, 2 and 3, the drill grinder and sharpener of the invention is provided with a frame or base 30 on which a motor 32 is supported in stationary position. The motor 32 is provided with a shaft 34, as shown in FIG. 3 of the drawings, which has a central rotary axis. Carried by the shaft 34 is a grinding wheel 38 which is rotatably mounted about the axis 36. The grinding wheel 38, as shown in FIG. 2, is provided with a grinding surface 40 which is disposed generally at right angles to the rotary axis 36 thereof.

The base 30 is provided with carriage support mechanism including a boss portion 42 in which a shaft 44 is pivotally mounted. This shaft 44 is provided with a pivotal axis 46 which is parallel to the axis 36 of the grinding wheel 38.

The shaft 44, as shown in FIG. 14, is provided with a flat portion 48 which is engaged and locked by an end 50 of a locking screw 52 which is screwthreaded into an internally screwthreaded bore 54 and the end 50 engages flat 48 on the side of the shaft 44.

As shown in FIGS. 2 and 13, the shaft 44 projects from the boss 42 and extends in a direction beyond the grinding wheel 38. The shaft 44, as shown in FIG. 13, is provided with a snap ring groove 58 in which a snap ring 60 provides an abutment bearing for a carrier support 62 which is pivotally moveable about the axis 46 of the shaft 44. The shaft 44 is provided with another snap ring groove 64 in which a snap ring 66 is disposed and this snap ring 66 abuts an end 68 of the member 62 in opposition to the abutment of the snap ring 60 by means of an end portion 70 of the carrier support 62.

A damping member 72 is retained in position at an end portion 74 of the carrier support 62 by means of a roll pin 76 and the member 72 is also provided with an opening 78 through which a clamp bolt 80 passes. This clamp bolt 80 clamps the member 72 against the end portion 74 of the carrier support 62 and thereby maintains a substantial frictional holding of the carrier support 62 relative to the periphery of the shaft 44 and also maintains precise location of the carrier support 62 against the snap ring 60. Thus, the member 72 provides for sufficient friction to hold the carrier support 62 in various manually adjusted positions as desired, but also permits freedom of movement of the support 62 about the axis 46 of the shaft 44, as will be hereinafter described in detail.

The carrier support 62 is provided with a flat normally upper surface 82 on which a plate 84 is mounted and held in juxtaposition thereon by a roll pin 86 which extends through the plate 84 and into carrier support 62.

This plate 84 is provided with an opening 88 extending therethrough which coincides with an opening 90 in the upper portion 82 of the carrier support 62, and extending through the openings 88 and 90 is the shank 92 of an externally screw-threaded member fixed to a carrier supporting post 94. The externally screwthreaded member 92 is engaged by an internally screwthreaded nut 96 which clamps against a washer 98 and holds the carrier supporting post 94 in juxtaposition on the upper surface of the plate 84.

The externally screwthreaded member 92 is provided with a substantially vertical axis 100 and an upper portion of the carrier supporting post 94 is provided with an axially horizontal opening 102 through which a bolt 104 extends. This bolt 104 is screwthreaded into an internally screwthreaded opening 106 of a downwardly extending portion 118 of a carrier 116 and carried by the post 94 is an arm 108 into which an externally screwthreaded bolt 110 is adjustably mounted. This bolt 110 is provided with a head 112 adapted to be engaged by the lower portion 114 of the carrier 116 to predetermine the angular adjustment of the carrier 116 about the axis of the bolt 104.

As shown best in FIG. 1, the post 94 is provided with a graduated degree scale 118 adapted to be indexed with a pointer 120 on the surface of the plate 84 so as to provide for calibrated adjustment of the post 94 about the vertical axis 100 of the post 94.

Likewise, a calibrated scale 122 is shown in FIG. 9 and is disposed on one side of the member 118. This scale 122 cooperates with an arrowhead 124 on the upper arcuate portion 126 of the post 94 so as to provide for the setting of the carrier 116 at an angle to the horizontal. The horizontal angular adjustment is provided by means of the axis of the bolt 104 which is disposed on a substantially horizontal axis.

Accordingly, the carrier 116 is adjustable relative to the surface 40 of the grinding wheel 38 on both a vertical axis, such as the axis 100, and on a horizontal axis in correspondence with the axis of the bolt 104.

Thus, the carrier 116 is adjustably pivotally mounted on the frame or base 30 of the machine to be adjusted about and fixed in position about a vertical axis, as well as a horizontal axis, namely the vertical axis 100 and the horizontal axis of the bolt 104.

It will be seen that, even though the axis of the shaft 44 is parallel to the axis 36 of the grinding wheel 38, the axis is offset relative to the axis 36 so that the longitudinal axis of the generally L-shaped in cross section carrier 116 is directed to a portion of the grinding wheel surface 40 which is laterally displaced from the axis 36. This provides for the holding of the drill guide and holder in the carrier 116 at a compound angle compatible with the grinding of twist drill points at a combined cone angle and rake or heel relief angle, as will be hereinafter described in detail.

Figures 16, 17, 18, 19:
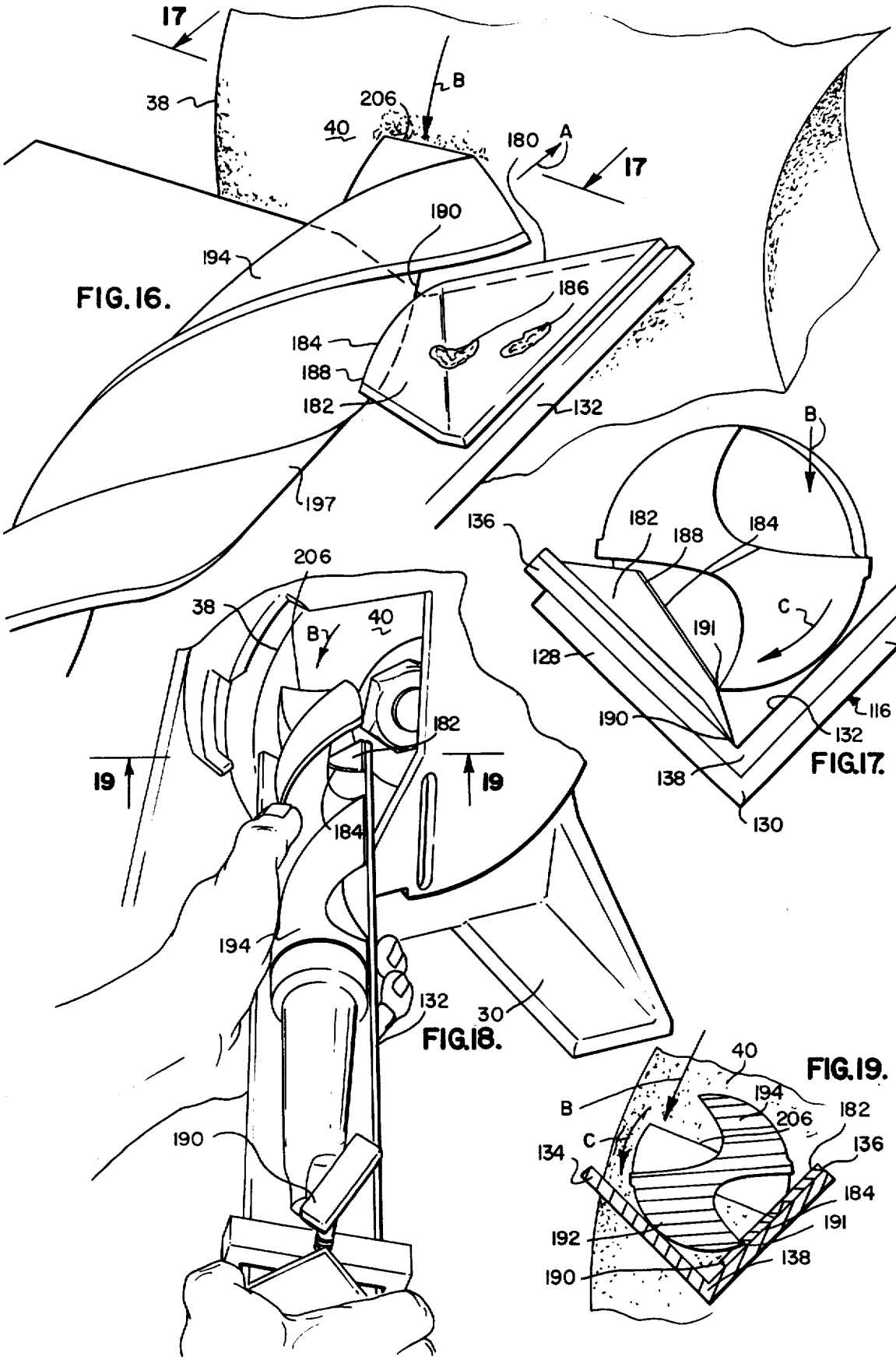
FIG. 16 is a perspective view of a drill in the drill guide and holder of the invention and showing the flute engaging means in engagement with the trailing edge of a helical flute portion of the drill.
FIG. 17 is a view taken from the line 17—17 of FIG. 16 looking directly at the cutting point of the drill held in the drill guide and holder of the invention.
FIG. 18 is a bottom plan view of the point portion of a drill as received in the drill holder, with the latter being illustrated in phantom outline.
FIG. 19 is a sectional view taken from the line 19—19 of FIG. 16 further illustrating the torque relationship applied by grinding the facets of the drill point against the grinding wheel which imparts torque tending to rotate the drill in a direction to cause one of its flutes to engage a stationary flute engaging structure of the invention.

As shown best in FIGS. 10, 11 and 17 for example, the carrier 116 has a cross sectional shape which is substantially L-shaped or may be termed a right angle V-shape in cross section structure, which is similar to a conventional angle iron. The carrier 116 is elongated at right angles to its cross section, as shown in FIG. 11 for example, and is provided with a pair of downwardly converging wall portions 126 and 128 which are integral with each other at an apex portion 130 which is inverted, as shown in FIG. 11, and which may be considered to be a juncture of the two walls 126 and 128.

It will be understood that the downwardly converging walls 126 and 128 may function in a similar manner to a conventional precision V-block arrangement which provides for relative alignment of a longitudinal member, such as the drill guide and holder 132 which is of generally conforming cross section, as shown in FIGS. 10 and 11. This drill guide and holdeer 132 is provided with downwardly converging walls 134 and 136 which nest in and generally conform to the walls 126 and 128 of the carrier 116. The walls 134 and 136 of the drill guide and holder 132 are integral with each other at an inverted apex portion 138, which may be considered to be a juncture of the two wall portions 134 and 136. It will be appreciated that this drill guide and holder, as will be hereinafter described in detail, may be of caried construction, such as set of V-blocks or the like, carried by the carrier 116 and moveable therein for the purpose of providing for the support of the drill in connection therewith and for maintaining it in certain axial alignment with the longitudinal axis of the carrier 116.

The carrier 116 is provided with an open end 140 directed toward the grinding surface 40 of the grinding wheel 38 and the carrier 116 is provided with an opposite end 142 engageable by an end 144 of an adjusting screw 146 which is screwthreaded into a block 148 fixed to an end 150 of the drill guide and carrier. The screw 146 has a manually engageable adjustment knob 151 and the externally screwthreaded adjustment screw 146 is screwthreaded into a hand operated lever 152 which bears against a resilient washer 154 to provide for frictional locking of the screw 146 relative to an end of the internally screwthreaded nut 148 which is fixed to the apex portion 138 of the drill guide and holder 132. Thus, the end 144 of the screw 146 may abut the end 142 of the carrier 116 for adjustment of a drill grinding operation, as will be hereinafter described in detail.

The resilient washer 154 is made of rubberlike material and is compressible and has a high coefficient of friction so that the locking lever 152 may be rotated clockwise into compressive relationship with the resilient washer 154 and to thereby provide for axial loading of the screwthreaded portion externally of the screwthreaded member 146 after an adjustment has been made by means of the manually engageable knob 151 thereon, as will be hereinafter described in detail.

An abutment means 156, shown best in FIGS. 9 and 11, is adjustably and moveably supported on the drill guide and holder 132 and may be fixed in various positions longitudinally thereof. This abutment means 156 is provided with an abutment side 158 and is disposed to provide an abutment stop for the drill shank end of a twist drill, as will be hereinafter described in detail.

The abutment means 156 is provided with a body 160 having downwardly converging sides generally conforming to the walls 134 and 136 of the drill guide and holder 132 hereinbefore described.

As shown in FIGS. 9 and 11, a clamp bar 163 overlies the body 160 and is disposed in a substantially U-shaped notch 162 which is disposed laterally in an upper portion of the body 160. The clamp bar 163 is provided with hook portions 164 and 166, which extend over and engage the under sides of the walls 134 and 136 of the drill guide and holder 132.

Screwthreaded in the bar 163 is an externally screwthreaded member 168 having a manually engageable head 170 adapted for use in rotating the screw 168 in an internally screwthreaded opening 172 in the bar 163 so that an end portion 174 of the screwthreaded member 168 will bear upon a surface 176 in the notch 162 of the body member 160. It will be seen that when the manually adjustable knob 170 is rotated, the screw 118 advances in a screwthreaded manner through the internally screwthreaded opening 172 and causes force to be exerted on the surface 176 of the body 160, bringing an opposite reaction and force to cause the hook portions 164 and 166 to frictionally engage the lock against the under sides of the walls 134 and 136 of the drill guide and holder 132. Thus, tightening of the screwthreaded member 168 will fix the abutment mechanism 156 in location such that the abutment face 158 thereof is precisely located in fixed position, and this location may be changed by loosening the screwthreaded member 178 and sliding the body 160 internally along the drill guide and holder 132 until another desired location is found, in accordance with the length of a drill to be sharpened; said length being from the shank end of the drill which abuts the surface 158 to the point of the drill, the facets of which are to be ground on the surface 40 of the grinding wheel 38, as will be hereinafter described.

The drill guide and holder is provided with an open end 180, which is opposite to the end at which the internally screwthreaded member 148 is fixed. Mounted on the wall 136 of the drill guide and holder near the end 180 thereof is a drill flute edge engaging structure 182. This drill flute engaging structure 182 is shown best in FIGS. 16, 17, 18 and 19, with the general location thereof shown in FIGS. 1, 3 and 8 of the drawings.

As shown in FIGS. 16, 17, 18 and 19, the drill flute edge engaging structure 182 is fixed to the inner side of the wall 136 of the drill guide and holder 132. Structure 182 has an edge face 184 presenting a corner line 14, which engages the trailing edge of the flute with a point contact, as illustrated at 18 in FIGS. 18 and 19. Structure 182 has an end portion 16 of gradually diminishing thickness which accommodates drills of small diameter. Edge face 184 extends to an angle downwardly and toward the open end 180 of the drill guide and holder 132. The edge face 184 declines toward said open end 180 and extends into close proximity to the apex 138, as shown in FIG. 17, or to the juncture of the walls 134 and 136. As shown in FIGS. 16 and 18, the structure 182 is secured by spot welds or other suitable fixtures 186 to the wall 136 of the drill guide and holder 132 and the edge face 184, at its upper portion 188, is farther away from the wall 136 than is the normally lower portion 190 of the edge face 184, such that various diameter drills may be nested and/or aligned between the downwardly converging walls 134 and 136, and the smaller drills at their flute portions may engage the edge face 184 relatively near the lower portion 190 of the edge face 184 while larger diameter drills at their flute portions may engage the edge face 184 at a location substantially above the lowermost portion 190.

It will be seen that the edge face 184, as shown in FIG. 16, extends into the flute of a drill and that the edge 191 of a flute 192 of a drill 194 engages the edge face 184 and passes helically thereunder as the drill is advanced in the direction of the arrow A between the converging walls 134 and 136 of the drill guide and holder when the abutment means 156, as shown in FIG. 18, is advanced in a direction so as to engage a shank end of the drill 194, as will be hereinafter described. Edge 191, of flute 192, is essentially a line. Thus, it engages edge 14 of edge face 184 at point 18 (FIGS. 18 and 19). Point contact 8 is in contrast to a line contact as would be the case if the entire edge face 184 engaged flute edge 191.

As shown in FIGS. 1 and 3 to 7, inclusive, of the drawings, a set-up holder 200 is generally of the same cross section as the hereinbefore described carrier 116 and this set-up holder 200 is adapted to receive the open end 180 of the drill guide and holder. Positioned at the end of the set-up holder 200 is a scribed plate 202 having a series of scribed lines 204 thereon, and as shown in FIGS. 4 to 7, inclusive, of the drawings, the drill guide and holder 132 is nested in the set-up holder adjacent to the plate 202.

Figure 4:
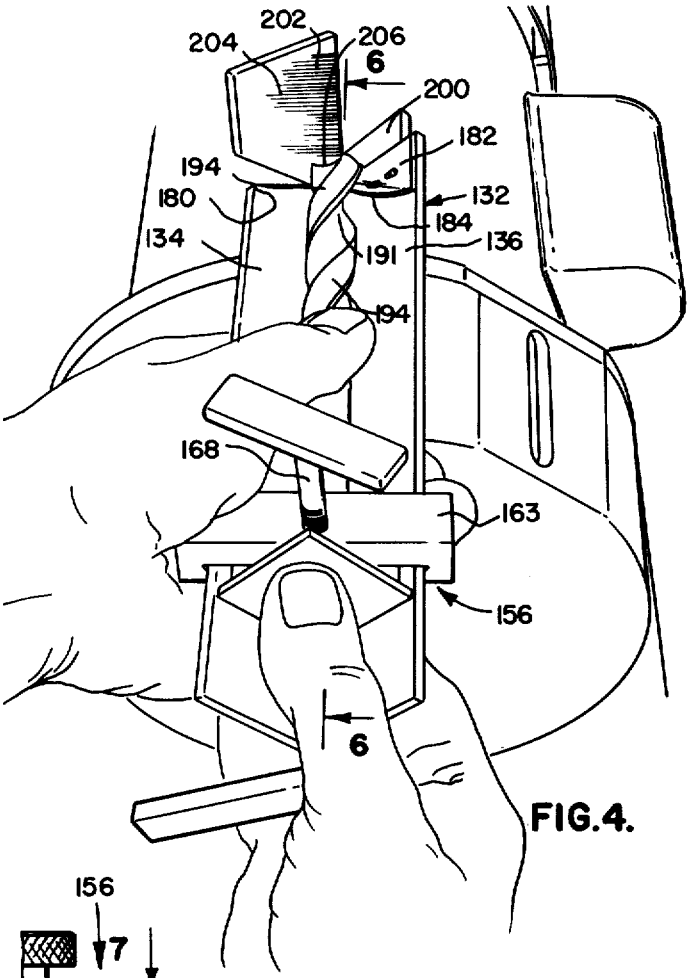
FIG. 4 is a perspective view of the drill guide and holder of the invention held in a person's hands the the cutting lip being adjusted relative and parallel to a scribed line template so as to properly locate the cutting lip of one facet of a drill to cooperate with the proper relationship to the grinding wheel and with the angular disposition at which the drill is held by the carrier of the drill guide and holder not shown in FIG. 4 but illustrated in other views of the drawings.
Figure 5:
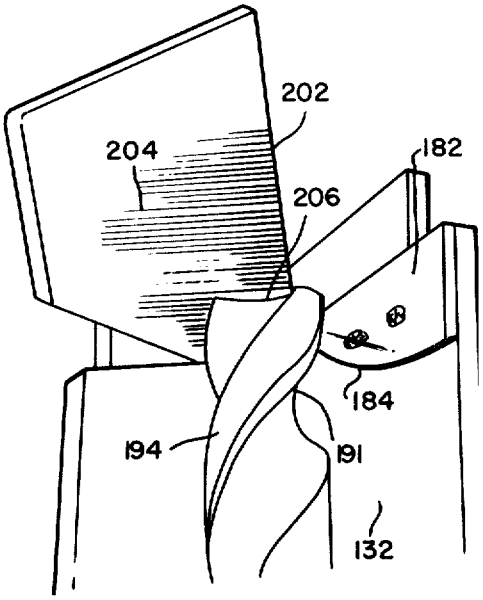
FIG. 5 is an enlarged fragmentary view similar to FIG. 4 but showing the drill point lip of a drill relative to a scribed line template and to the drill flute engaging means of the drill holder.
Figure 6:
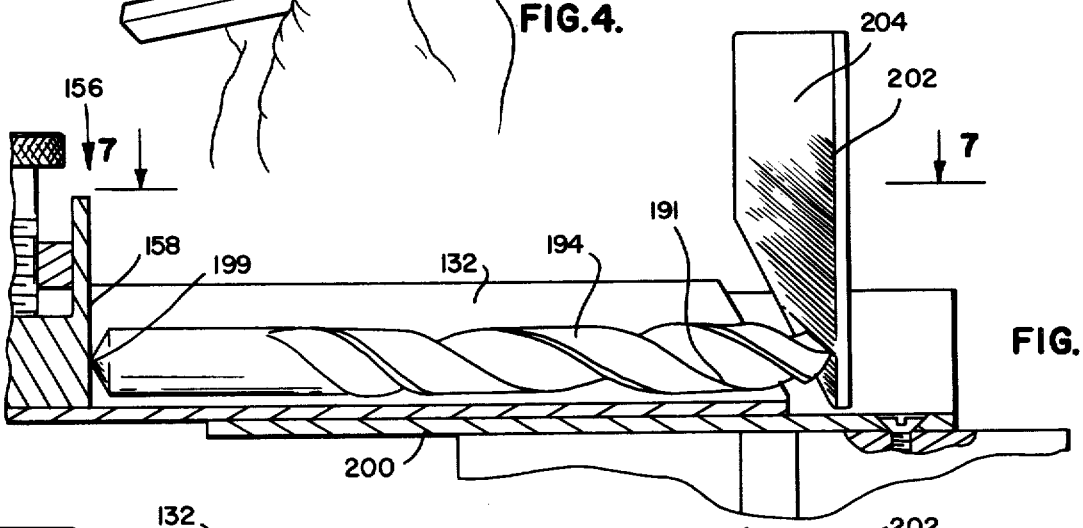
FIG. 6 is a sectional view taken from the line 6—6 of FIG. 4.
Figure 7:
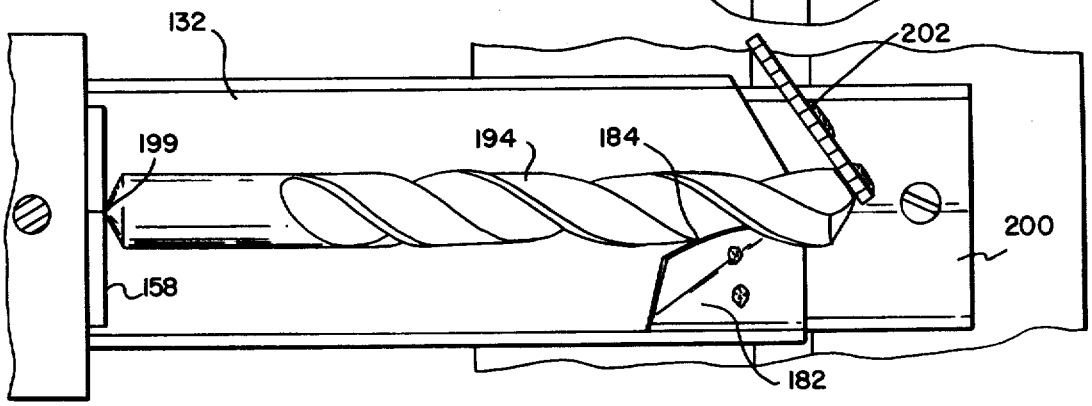
FIG. 7 is a view taken from the line 7—7 of FIG. 6.

The operator's hands, shown in FIG. 4 of the drawings, hold a drill nested in the convergence between the walls 134 and 136 with a flute 192 of a drill 194 in engagement with the edge face 184 of the drill flute engaging structure 182. The drill is advanced toward the plate 202 until a cutting lip 206 of the drill 194 is in parallel alignment with a respective scirbed line 204 on the plate 202. At this time, the abutment surface 158 of the abutment mechanism 156 is in precise engaged relationship with the shank end 199 of the drill 194. It will be understood that the screw 168, shown in FIG. 9, may then be tightened, fixing the abutment mechanism 156 so that the abutment surface 158, together with the flute engaging edge 184, fixes the drill 194 in position, such that its cutting lip 206 is aligned with one of the scribed lines 204 on the plate 202.

It will be appreciated that various diameter drills will match up with various ones of the scribed lines 204 and when the abutment mechanism is fixed in place with the drill engaging at its flute portion, the edge 184 of the flute engaging structure, the drill holder and guide is then ready to be placed in nested relationship within the carrier 116 and the carrier 116 provides for axial alignment of the drill which is axially aligned longitudinally in the drill guide and holder and with relation to the adjustments about the vertical axis of the post 94 and the horizontal axis of the bolt 104 so as to provide a proper cone angle, as well as a heel relief angle, of a respective cutting point facet as it is ground on the surface 40 of the grinding wheel 38.

In adjusting the lip 206 of the drill 194 to a grinding position with respect to the surface 40 of the grinding wheel, the adjusting screw 146 is adjusted so that its end 144 abuts the end 142 of the carrier 116, and the lever 152 is turned clockwise to compressively engage the washer 154 which resiliently locks up the threads 146 in the nut 148. The facet of the drill 194 respective to the lip 206 is first ground by passing the drill over the surface 40 by pivoting the carrier support 62 about the axis 46 of the shaft 44 such that the respective facet of the drill point completely traverses the surface 40 of the grinding wheel in a generally radial direction. The facet of the drill is cut until the sparking on the wheel is substantially reduced and the particular facet so ground is inspected to determine whether or not the lip 206 has been ground clean. If not, the locking lever 152 is released and the screw 146 is turned slightly counterclockwise away from the end 142 of the carrier 116, allowing the drill guide and holder 132 to move a further distance slightly toward the surface 40 of the grinding wheel 38 after the clamp-on 152 has fixed and screw 146 is the respective adjusted position. The drill is again pivotally passed over the surface 40 about the axis 46 until the sparking is reduced and then the drill is retracted from the surface of the wheel 38 by sliding the drill guide and carrier 132 in the carrier 116.

The drill is then rotated 180 degrees such that the remaining facet at the point of the drill is presented for grinding, and in this position, the respective flute of the drill is engaged by the edge face 184 of the drill flute engaging structure 182 and the respective shank end of the drill 194 is in abutment with the abutment surface 158 of the abutment structure 156.

The drill guide and holder 132 is then axially advanced in the carrier 116 until the drill point facet is being ground by the rotation of the grinding wheel 38; the facet being ground on the surface 40 which is at right angles to the axis 36 of the grinding wheel 38. Again, the drill 194 in the drill guide and holder and carrier 116 is pivoted back and forth about the axis 46, hereinbefore described, until the sparking is substantially reduced.

It will be appreciated that the abutment surface 158, engaging the end of the drill shank and the respective edge face 184 of the flute engaging structure being in engagement, will provide for precise grinding of the second facet of a drill point relative to the first one which has been ground.

It will be noted, as shown in FIGS. 1, 3, 17 and 19, that the respective arrows B indicate the rotational direction of the surface 40 of the grinding wheel 38, which surface 40 is at right angles to the rotational axis 36 of the grinding wheel. The rotational direction B is shown specifically in FIGS. 1, 3, 16, 17, 18 and 19.

The cutting lip of the drill 194, which is designated 206, when engaged with the grinding wheel, creates torque which is imparted to the drill 194, tending to rotate the respective flute 192 into engagement with the edge 14 of edge face 184 and, at the same time, the drill is held by a person's hands as shown in FIG. 8, so that torque of the grinding wheel forces the helical drill flute edge 191 firmly into engagement with the edge 14 of edge face 184 of the drill flute engaging structure, and at the same time forces the end 199 of the drill shank against the abutment surface 158 of the abutment mechanism 156. Thus, precise holding of the drill 194 in the drill guide and holder 132 is assured during the manual holding of the drill guide 132 and drill 194 as it is forced toward the grinding wheel surface 40 to a position in which the end 144 of the adjustment screw 146 is abutted to the end 142 of the carrier 116.

As disclosed in the drawings, especially FIG. 16 to 19 inclusive, the edge 14 of edge face 184 of the drill flute engaging structure 182 engages the trailing edge of the drill 194 due to the fact that it is on the relief side of the drill and does not usually become knicked or badly worn and is, therefore, a most accurate indexing area for engagement with the edge 14 of edge face 184 of the drill flute engaging structure 182.

It will be obvious, however, that the mechanism of the invention may be constructed subtantially in reverse where the axis 46 of the carrier support 62 may be mounted toward the right hand side of the axis 36, as shown in FIG. 1 and 3 of the drawings, and the carrier 116, as well as the drill guide and holder 132, may be disposed at a corresponding angle at the opposite side of the axis 36 so as to provide for torque reaction of the drill 194 in the opposite direction to that as shown in FIG. 16, which would require that the flute engaging structure 182 would be located on the side wall 134 of the drill guide and holder 132 and that the edge 184 of the structure 182 would engage a cutting edge of a respective drill flute which, of course, would not be the preferred form of the invention, but which would be an operable arrangement.

As shown in FIG. 8 of the drawings, only slight pressure of a person's hands is required to maintain the drill 194 in the drill guide and holder 132 at a time, as shown in FIG. 18, when the lip 206 and its corresponding facet are being ground, and that the torque imparted by the grinding wheel surface 40, as indicated by the arrow B, is such as to impart torque force which forces the flute edge 191 of the drill 194 into firm engagement with the drill flute engaging edge 184 of the structure 182 and while at the same time forcing the end 199 of the drill 194 into intimate contact with the abutment surface 158 of the abutment means 156. Thus, precise repeatability of drill grinding operations on subsequent drill point facets may be accomplished with the simple holding of the drill in the drill guide and holder 132, all as hereinbefore described.

Arrows C indicate the rotational direction to which torque is imparted to the drill 194 as the grinding surface 40 of the grinding wheel moves in the direction of the arrow B.

Figure 20:
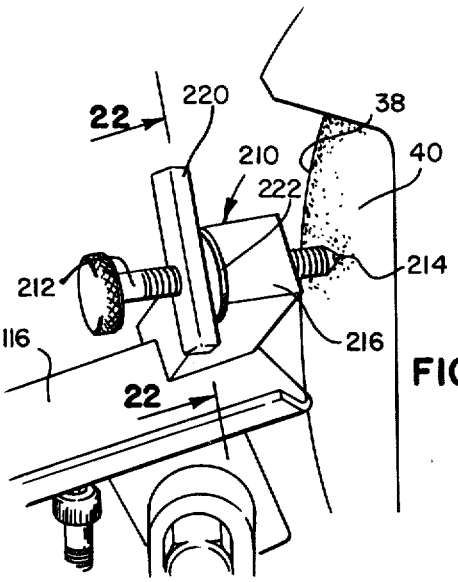
FIG. 20 is a perspective view of a dressing tool mounted on the carrier of the machine of the invention for use in dressing the grinding surface of the grinding wheel of the invention.
Figure 21:
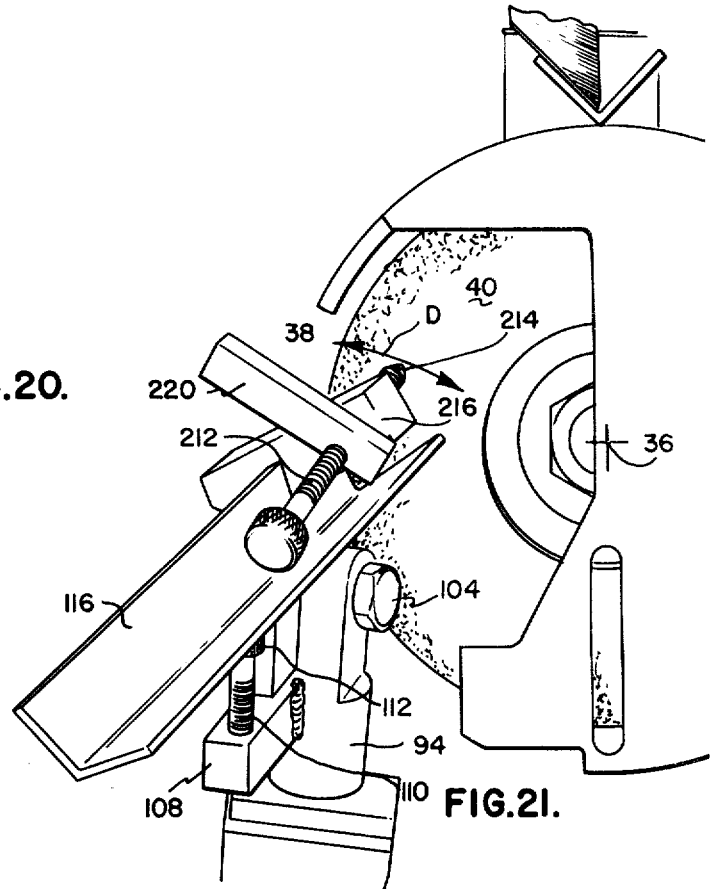
FIG. 21 is a view similar to FIG. 20 but showing the sweeping of the dressing tool over the grinding surface of the wheel about an axis parallel to the rotary axis of the grinding wheel which has its face at right angles to its rotary axis.
Figure 22:
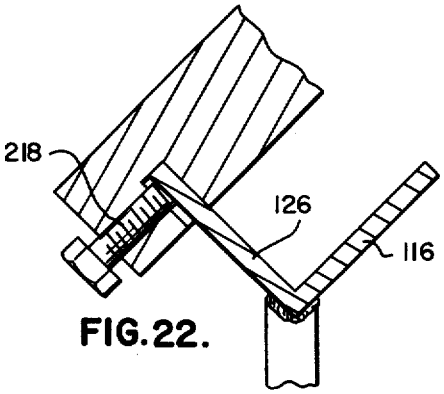
FIG. 22 is a fragmentary sectional view taken from the line 22—22 of FIG. 20.

In accordance with a method of operation of the invention, a grinding wheel dressing tool 210 is shown in FIGS. 20 and 22 of the drawings. This dressing tool 210 is provided with an adjustment screw 212 adapted to adjust a dressing point 214 toward the grinding surface 40 of the wheel 38 and the screwthreaded adjustment screw 212 is screwthreaded in a block 216 which is held on the side 126 of the carrier 116 by means of a clamp screw 218. A locking arm 220 bears upon a resilient washer 222 against the member 216, so as to lock the dressing tool 214 in adjusted position. The dressing tool 214 is then swept across the surface 40 of the grinding wheel in both directions, as indicated by a double ended arrow D, until the surface 40 is smooth and flat and truly at right angles to the rotary axis 36 of the grinding wheel 40. The dressing tool 210 is then removed and the drill guide and holder is again replaced in the carrier 116 and the aforementioned drill grinding procedure is carried out by sweeping the point of the drill across the previously dressed surface 40, it being noted that the dressing operation is carried out by sweeping the dressing tool about the axis 46 which is the same axis about which the cutting point or facet of the drill is swept as it is sharpened. It will be understood that this provides for very accurate coordination of the wheel surface dressing, as well as the grinding or drill points facets thereon, due to the fact that they are both accomplished about the same pivotal axis, namely the axis 46 as hereinbefore described. It will also be understood by those skilled in the art that drill sharpening by sweeping the drill facets across the grinding surface 40 of the wheel 38 prevents grooving of the surface 40 of the wheel 38 prevents grooving of the surface and consequent inaccuracy in the grinding of the drill point lip 206 and its respective facet at a proper conical angle, as well as a heel relief angle.

Figure 24:
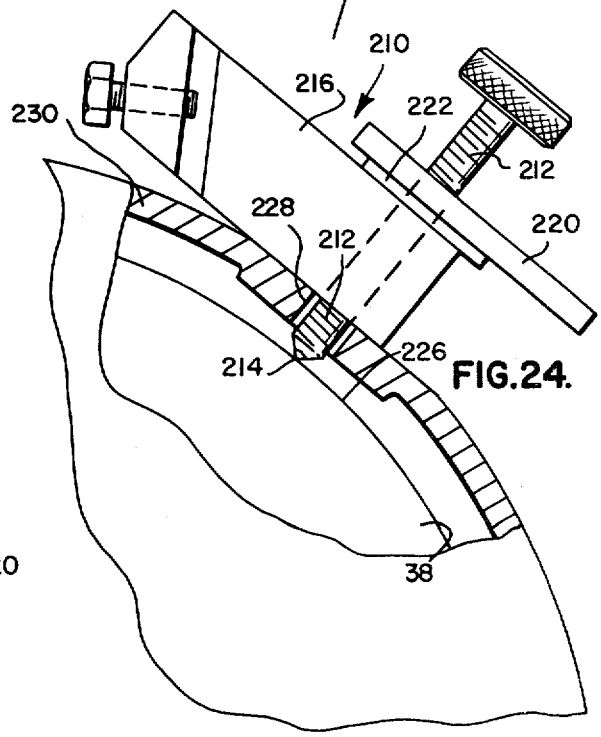
FIG. 24 is an enlarged fragmentary view taken from the line 24—24 of FIG. 23 and showing portions broken away and in section to amplify the illustration.
Figure 23:
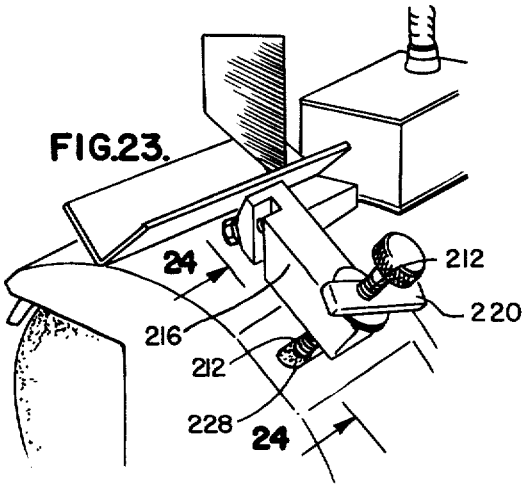
FIG. 23 is a perspective view of mechanism for use in dressing the periphery of the grinding wheel of the invention.

As shown in FIGS. 23 and 24, the dressing tool 210 may be used to dress the periphery 226 of the wheel 38 by extending the screwthreaded shank 212 of the dressing tool 210 through a slot 228 in a housing portion 230 of the frame 30. This housing portion, with its slot 228, is shown in FIG. 1 of the drawings and is an elongated slot allowing the dressing tool at its point 214 to be swept across the periphery 226 in accordance with the adjustments of the screw 212 and the locking arm 220, together with the resilient washer 222 hereinbefore described.

THE MODIFICATION

A modified embodiment of the invention is illustrated in FIGS. 25 to 29, inclusive. Post 94 and the mechanism associated therewith is the same as in FIG. 1. A table 250 is removeably and pivotally mounted on post 94 by a tab 252 which depends therefrom and is formed with an aperture 254 which receives a bolt (not illustrated) corresponding to bolt 104 of FIG. 1. Indicia 256 are inscribed on a face of tab 252 and cooperate with a pointer (not illustrated), which corresponds to pointer 124 of FIG. 1, to indicate the vertically adjusted position of table 250, which ranges between 0° and 40°.

The upper face of table 250 is formed with a threaded bore 258 (FIG. 28) and two arcuate segments of angular indicia are inscribed on this table surface on the axis of bore 258 as a center. One of these segments is for left angular adjustment and the other for right angular adjustment. Each segment indicates angles from 90° through 20° of horizontal adjustment.

A so-called fence 262 in the form of a rectangular bar is formed with a smooth bore 264 adjacent one end, and which functions as a bearing surface for a trunnion 266 formed integrally with a screw plug 268 and an operating knob 270 of a pivot unit designated generally 282.

A non-circular recess 272, which preferably is hexagonal, enters knob 270 from its upper face and is adapted to receive a complemental wrench for the purpose of tightening unit 282 in position on fence 262.

A rectangularly shaped recess 274 enters fence 262 from one side and adjacent to the end remote from aperture 264. Back surface 276 of recess 274 is inclined and presents a lower edge 278 which is a section of a radius taken from the axis 280 of trunnion 266 as a center.

Figure 25:
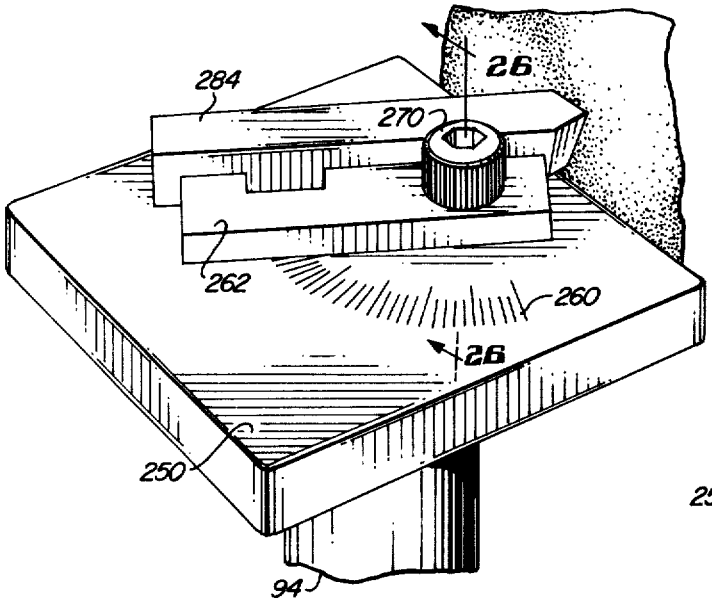
FIG. 25 is a perspective of the tool supporting table which replaces the drill holder.
Figure 26:
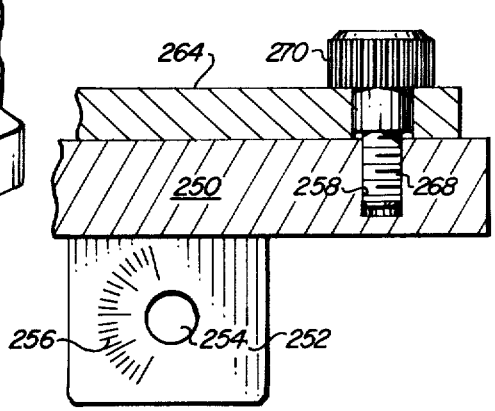
FIG. 26 is a detailed section through the tool supporting table being taken on the plane of the line 26—26 of FIG. 25.
Figure 27:
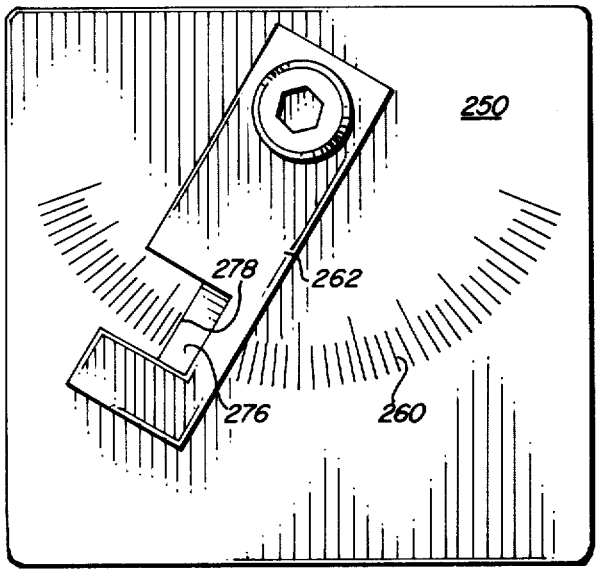
FIG. 27 is a top plan view of the tool supporting table.
Figure 28:
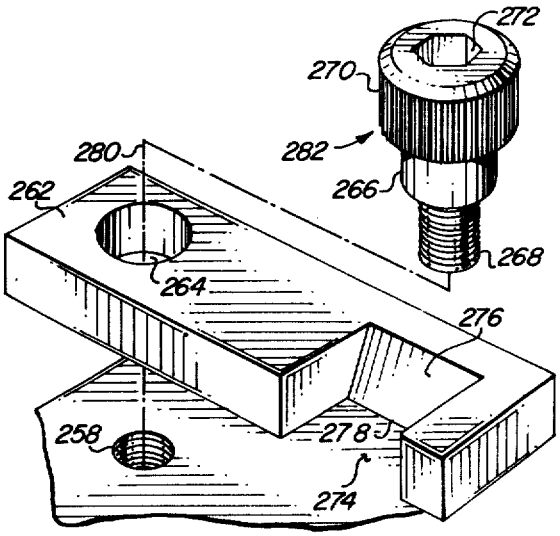
FIG. 28 is a perspective depicting a portion of the tool supporting table, an adjustable fence and a trunnion in exploded relation.
Figure 29:
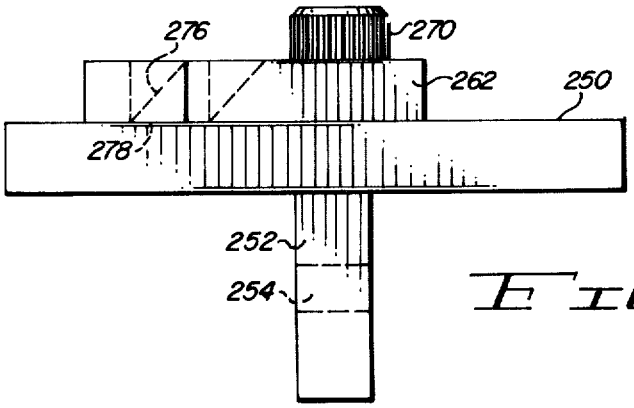
FIG. 29 is a side elevation of the elements of FIG. 28 as assembled.

With a table 252 mounted on post 94, as depicted in FIG. 25, a tool 284 is placed on table 250 with a side face thereof in abutting engagement with the side face of fence 262 into which recess 274 opens. Fence 262 is then adjusted about axis 280 until a desired angle is indicated by edge 278 in relation to indicia 260. Point 286 of tool 284 is then moved into engagement with face 40 of grinding wheel 38.

It will be obvious to those skilled in the art that the use of the grinding wheel surface to impart torque reaction to the drill 194 to hold its end 199 against the abutment 158 and to also hold one of its flute edges against the flute engaging edge 184 of the flute engaging structure 182 is a simple combination by which drills may be precisely sharpened and at the same time held by hand in the drill guide and holder 132 of the invention, as hereinbefore described.

It will be further obvious to those skilled in the art that various modifications may be resorted to without departing from the spirit of the invention.

What is claimed is:

1. In a sharpener for a drill having a pair of helical flutes, each of which has a trailing edge, a cutting point face having a pair of facets, and a shank:

(a) a frame;

(b) a rotatably mounted grinding wheel supported on said frame and having a grinding face;

(c) a drill guide and holder having a drill axis locating means;

(d) mounting means supporting said guide and holder on said frame for positioning said drill axis locating means so that a drill thereon is at an angle with respect to the grinding face of said grinding wheel for grinding one facet of the cutting points of the drill at a time;

(e) drill flute engaging means on said guide and holder to engage one of said trailing edges with a point contact while each facet of said cutting point is ground by said grinding face;

(f) said grinding wheel being rotatable in a direction to cause one of said facets to create rotary torque that is imparted to the drill to force said trailing edge of said flute against said flute engaging means; and (g) a drill shank abutment means on said guide and holder and disposed to be engaged by said shank to hold said drill in precise longitudinal position in said guide and holder to resist and prevent longitudinal axial movement of said drill in a direction away from said grinding face.

2. The invention as defined in claim 1, wherein: said mounting means comprises adjusting mechanism or adjustably supporting said drill guide and holder about two different axes which are at substantially right angles relative to each other.

3. The invention as defined in claim 1,, wherein: said mounting means comprising a carrier mounted on said frame; said carrier having alignment means moveably supporting said drill guide and holder; said alignment means disposed for engagement and support of said drill guide and holder so as to permit precise movement of said drill guide and holder on said carrier in a direction parallel to said drill axis locating means and the axis of a drill supported therein; and adjustable stop means disposed adjustably for holding a longitudinal position of said drill guide and holder relative to said carrier so as to permit precise feeding of said drill guide and holder relative to said carrier such that a drill in said drill guide and holder may be moved toward said grinding surfaces of said grinding wheel to a desired grinding position.

4. The invention as defined in claim 3, wherein: adjusting means adjustably supporting said carrier on said frame such that said carrier is pivotally adjustable about two different axes which are at substantially right angles to each other.

5. The invention as defined in claim 1, wherein: said abutment means is adjustably fixable in various positions relative to said drill guide and holder so as to accommodate drills of various lengths between their cutting points and shank ends.

6. The invention as defined in claim 3, wherein: said drill guide and holder is substantially V-shaped in cross section and said carrier is substantially V-shaped in cross section; said drill guide and holder nested in said carrier such that the V-shaped in cross section of the drill guide and holder and carrier are in general parallel relation to each other.

7. The invention as defined in claim 1, wherein: said grinding wheel is provided with a rotary axis; said grinding surface of said grinding wheel being disposed at a right angle to the rotary axis of said grinding wheel.

8. The invention as defined in claim 1, wherein: said drill flute engaging means is disposed to engage and hold a trailing edge of one flute of a drill while said grinding surface of said grinding wheel rotates and grinds a respective facet of a point of said drill, in a direction toward a cutting lip of said facet and in a direction opposite to the normal rotational direction of a drill when it is cutting metal.

9. The invention as defined in claim 1, wherein: said mounting means comprises adjusting mechanism for adjustably supporting said drill guide and holder about a substantially horizontal axis and also about a substantially vertical axis.

10. The invention as defined in claim 3, wherein: said drill guide and holder is provided with an internally screwthreaded nut, an externally screwthreaded member screwthreaded in said nut; said externally screwthreaded member adapted to be projected from said nut to engage a portion of said carrier; the axis of said externally screwthreaded member being substantially parallel to said drill axis locating means; an internally screwthreaded bar screwthreadably disposed on said externally screwthreadable member and resilient washer means disposed between said bar and said internally screwthreaded nut whereby tightening of said bar toward said nut causes compression of said resilient washer and frictional locking of the threads of said externally screwthreaded member in said internally screwthreaded nut.

11. The invention as defined in claim 1, wherein: said drill guide and holder is substantially V-shaped in cross section and said carrier is substantially V-shaped in cross section; said drill guide and holder nested in said carrier such that the V-shaped cross section of the drill guide and holer and carrier are in general parallel relation to each other; said mounting means comprising a carrier mounted on said frame; said carrier having alignment means moveably supporting said drill guide and holder; said alignment means disposed for engagement and support of said drill guide and holder so as to permit precise movement of said drill guide and holder on said carrier in a direction parallel to said drill axis locating means and the axis of a drill supported therein; and adjustable stop means disposed adjustably for holding a longitudinal position of said drill guide and holder relative to said carrier so as to permit precise feeding of said drill guide and holder relative to said carrier such that a drill in said drill guide and holder may be moved toward said grinding surface of said grinding wheel to a desired grinding position; said adjustable stop means comprising a screwthreaded member of said drill guide and holder adjustably adapted to bear upon said carrier in a direction parallel to said drill axis locating means and a screwthreaded locking member on said screwthreaded means adapted to lock said screwthreaded means in a fixed position.

12. The invention as defined in claim 6, wherein: said V-shaped in cross section drill guide and holder is provided with downwardly converging straight walls; said drill guide and holder being elongated in a direction at right angles to said V-shaped cross section; said drill axis locating means constituted by said downwardly converging straight walls of said V-shaped in cross section drill guide and holder; said drill flute engaging means being disposed in slight spaced relationship to one of said walls; said drill flute engaging means having an engaging portion disposed at an angle to the elongated idrection of the respective one of said walls; said drill guide and holder having an open end beyond which the point end of a drill may be projected; said engaging portion of said flute engaging means declining at said angle toward said open end of said drill guide and holder.

13. The invention as defined in claim 12, wherein: said flute engaging means at said declining angle being disposed to engage flutes of small diameter drills near the convergence of said straight walls and said engaging means due to its declining angle disposed to engage flutes of relatively larger diameter drills at distances relatively farther away from said convergence.

14. The invention as defined in claim 6, wherein: drill cutting lip alignment means comprises a third V-shaped in cross section member in which said drill guide and holder may be nested; said third V-shaped in cross section member having a pair of converging walls; a line scribed member disposed at a location and at an angle to and between said converging walls; said line scribe member having a plurality of adjacent parallel lines with one of which a cutting lip of a drill of a certain diameter will align when said abutment means is disposed properly to hold the point of said drill in proper grinding and sharpening position.

15. The invention as defined in claim 9, wherein: said grinding wheel is provided with a generally horizontal axis which is offset relative to said substantially vertical axis on which said mounting means is adjustably supported.

16. The drill sharpener of claim 1, in which the drill flute engaging means presents an edge face having a corner line which engages the trailing edge of the flute to create the point contact.

17. The drill sharpener of claim 1, in which the drill flute engages means gradually diminishing in thickness from a point spaced from the end remote from said shank to said end.

* * * * *